US009422682B2

(12) United States Patent
Faught, Jr.

(10) Patent No.: US 9,422,682 B2
(45) Date of Patent: Aug. 23, 2016

(54) BOX BROOM SWEEPER WITH AN ADJUSTABLE BOTTOM SURFACE ATTACHMENT

(71) Applicant: Don L. Faught, Jr., Occoquan, VA (US)

(72) Inventor: Don L. Faught, Jr., Occoquan, VA (US)

( * ) Notice: Subject to any disclaimer, the term of this patent is extended or adjusted under 35 U.S.C. 154(b) by 8 days.

(21) Appl. No.: 14/515,389

(22) Filed: Oct. 15, 2014

(65) Prior Publication Data

US 2016/0108592 A1 Apr. 21, 2016

(51) Int. Cl.
*E01H 1/04* (2006.01)
*E01H 1/05* (2006.01)

(52) U.S. Cl.
CPC ..... *E01H 1/045* (2013.01); *E01H 1/047* (2013.01); *E01H 1/056* (2013.01)

(58) Field of Classification Search
CPC ..... E01H 1/02; E01H 1/04; E01H 1/045; E01H 1/047; E01H 1/05; E01H 1/056
USPC ..... 15/82, 83
See application file for complete search history.

(56) References Cited

U.S. PATENT DOCUMENTS

| | | | | |
|---|---|---|---|---|
| 3,178,746 A | | 4/1965 | Voelstad | |
| 3,568,232 A | | 3/1971 | Swanson | |
| 4,895,476 A | | 1/1990 | Vangaever | |
| 5,249,332 A | | 10/1993 | Wilkerson | |
| 5,742,967 A | | 4/1998 | Giessler | |
| 5,924,155 A | * | 7/1999 | Broz | E01H 1/045 15/83 |
| 2003/0182748 A1 | * | 10/2003 | Watts | E01H 1/045 15/83 |
| 2009/0089965 A1 | | 4/2009 | Vanderlinden | |

FOREIGN PATENT DOCUMENTS

| | | | |
|---|---|---|---|
| EP | 2 463 441 A2 | | 6/2012 |
| FR | 2830550 | * | 4/2003 |
| JP | 11-21838 | * | 1/1999 |
| JP | 11-264123 | * | 9/1999 |

OTHER PUBLICATIONS

"Skid Steer Boxbroom Sweepers," Spartan Equipment website: http://www.spartanequipment.com/categories/Skid-Steer-Attachments/Boxbroom-Sweepers/ (last accessed on Jul. 13, 2014) 2 pages.

* cited by examiner

*Primary Examiner* — Mark Spisich
(74) *Attorney, Agent, or Firm* — Richard C. Litman

(57) ABSTRACT

The box broom sweeper with adjustable bottom surface attachment can include a box broom having a broom and a housing. The housing can include a top portion, a bottom portion having a guard, opposing front and rear ends, two opposing side walls connecting the top portion and the bottom portion, and an adjustable bottom surface attachment. The adjustable bottom surface attachment includes a plate and two opposing sides extending from the plate. The two opposing sides of the adjustable bottom surface attachment extend along corresponding side walls of the housing. The adjustable bottom surface attachment can be detachably coupled to the side walls of the housing to allow the adjustable bottom surface attachment to be detached when a front portion of the plate becomes damaged. The adjustable bottom surface attachment can be coupled to the box broom housing by welding.

6 Claims, 3 Drawing Sheets

BOX BROOM SWEEPER WITH AN ADJUSTABLE BOTTOM SURFACE ATTACHMENT

BACKGROUND OF THE INVENTION

1. Field of the Invention

The present invention generally relates to street cleaning systems and more particularly to an adjustable bottom surface attachment for a box broom sweeper.

2. Description of the Related Art

Box brooms that are adapted to be attached to a vehicle, such as a skid-steer loader or skidsteer, have a variety of different uses. For example, box brooms can be used for general maintenance sweeping, such as picking up common gutter debris for basic street maintenance, or for picking up loose gravel, sand, small debris, or litter from airport roads, gates areas, and tarmac. Box brooms can also be used for cement plant cleanup, which includes picking up materials such as crushed lime, coke, and finished cement product. Typically the cost for each box broom ranges from approximately $6,000 USD to $8,000 USD.

The repeated use of the box broom in environments such as those described above not only damages the guard of the box broom, but also, and more importantly, causes the bottom of the box broom to become deleveled so as to allow loose gravel, sand, crushed lime, etc. to remain on the surface; thereby, rendering the box broom ineffective and unusable and forcing the user to purchase a new replacement box broom.

Thus, an adjustable bottom surface attachment for a box broom solving the aforementioned problems is desired.

SUMMARY OF THE INVENTION

The box broom sweeper with adjustable bottom surface attachment can include a box broom having a broom and a housing. The housing can include a top portion, a bottom portion having a guard, opposing front and rear ends, two opposing side walls connecting the top portion and the bottom portion, and an adjustable bottom surface attachment disposed over the bottom portion. The adjustable bottom surface attachment includes a plate and two opposing flanges or sides extending upward from the plate. The two opposing sides of the adjustable bottom surface attachment can be connected to the side walls of the housing and configured to extend at least partially along the side walls. The adjustable bottom surface attachment can be detachably coupled to the side walls of the housing to facilitate removal of the adjustable bottom surface attachment when the plate becomes worn down or damaged. The adjustable bottom surface attachment can be coupled to the box broom housing by welding.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1:
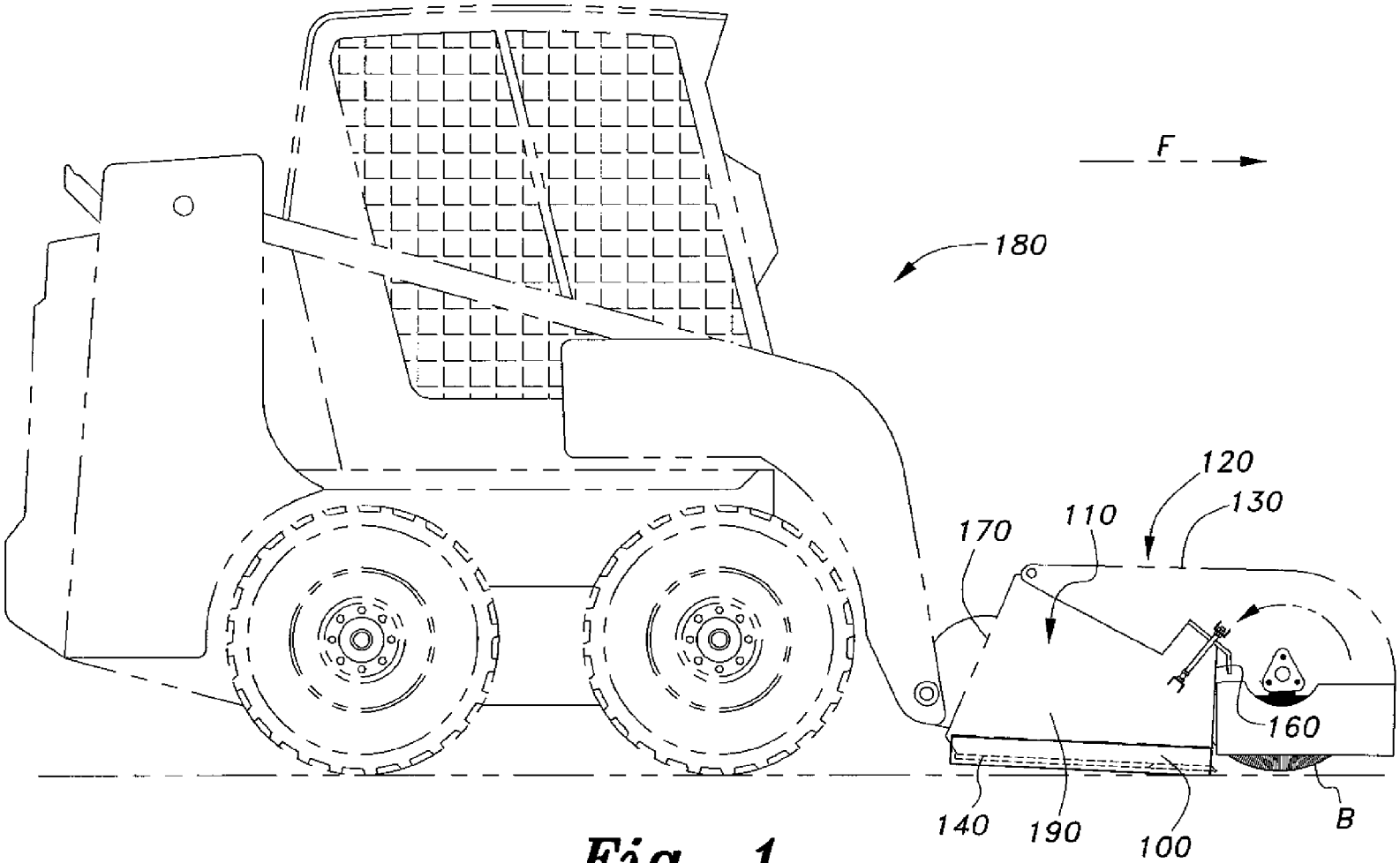
FIG. 1 is an environmental, side view of a skid-steer loader having a box broom sweeper with adjustable bottom surface attachment according to the present invention, showing movement in a forward direction.
Figure 2:
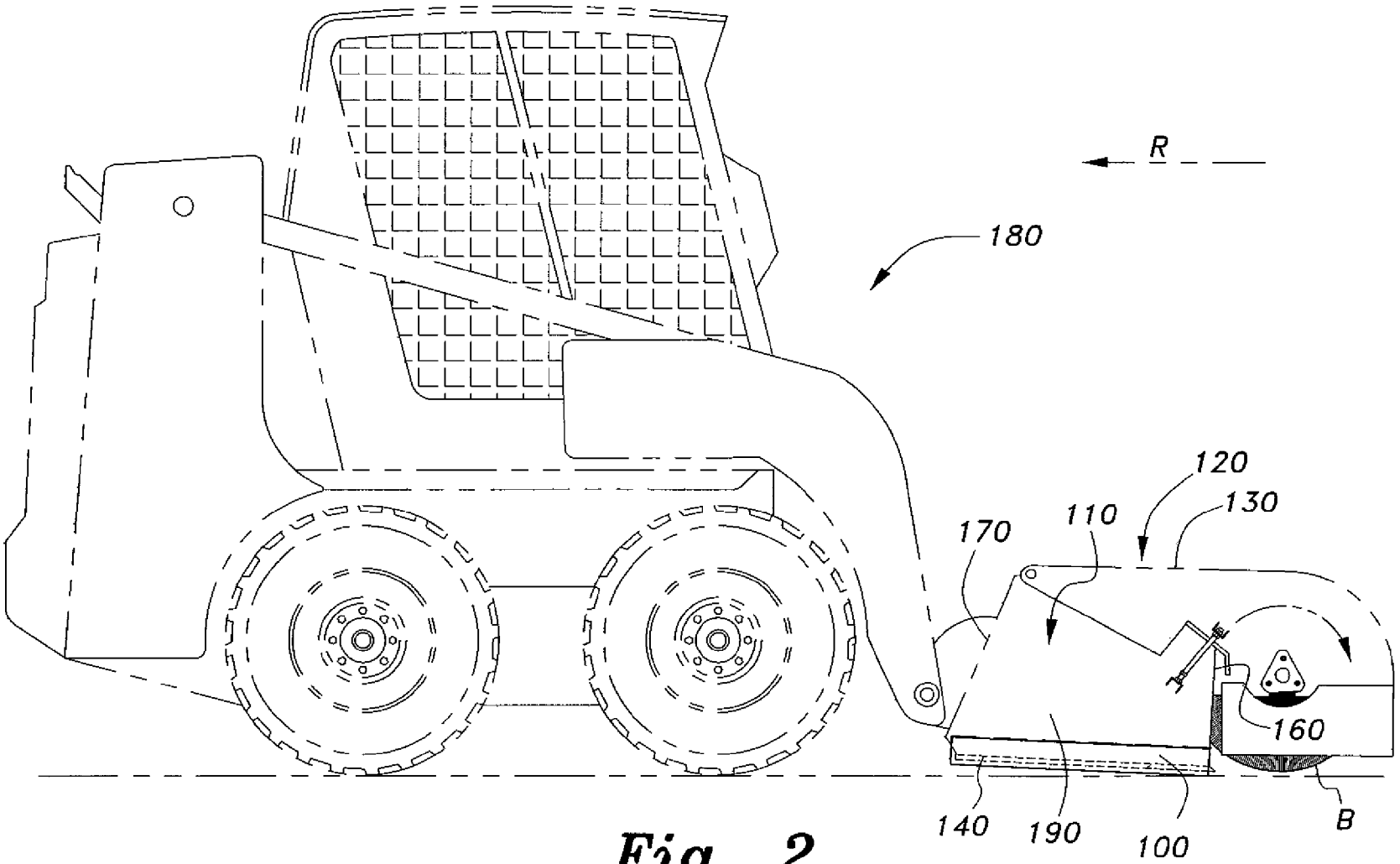
FIG. 2 is an environmental, side view of a skid-steer loader having a box broom sweeper with an adjustable bottom surface attachment according to the present invention, showing movement in a backwards direction.
Figure 3:
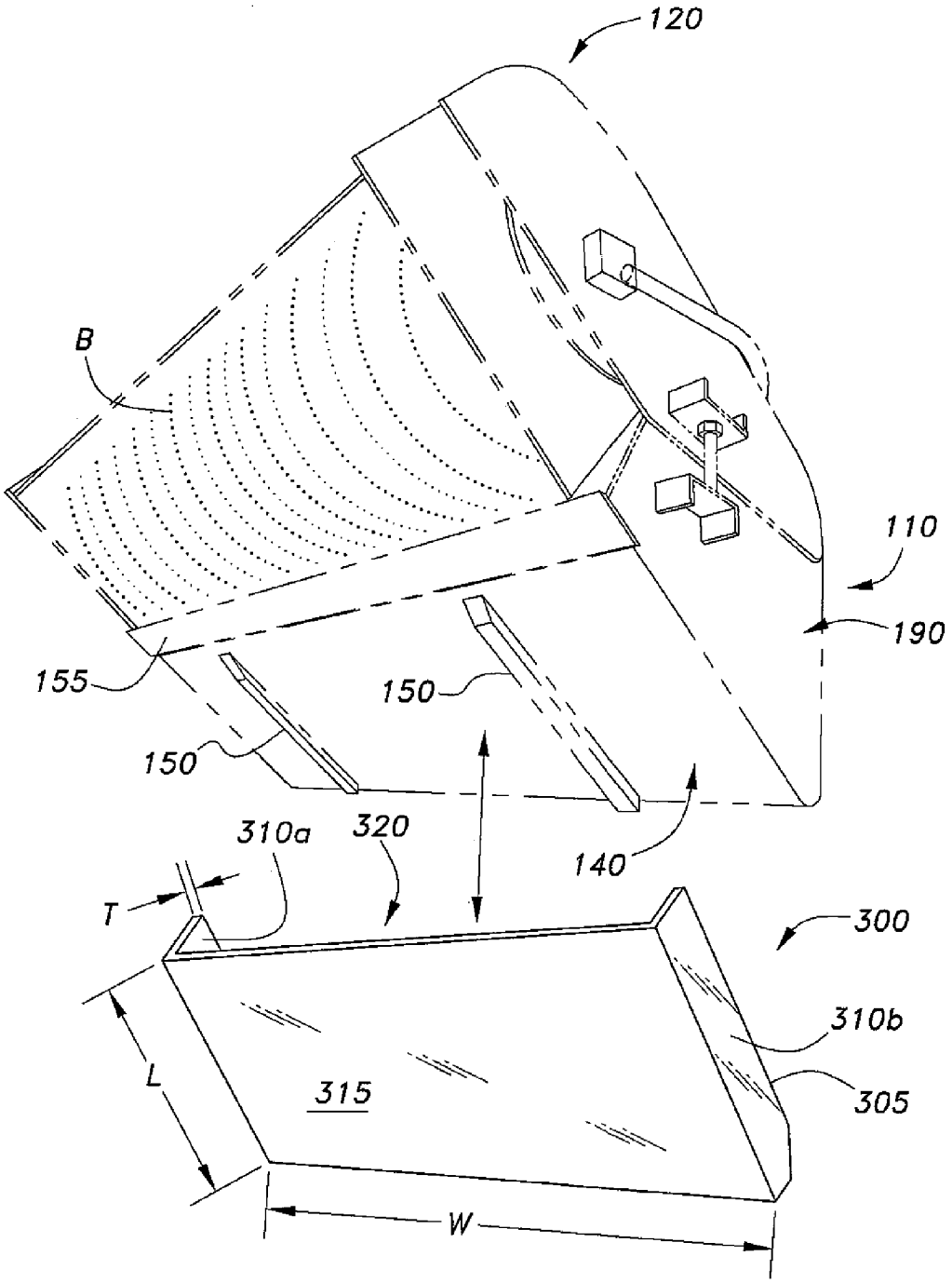
FIG. 3 is an environmental, bottom, perspective view of the box broom sweeper with an adjustable bottom surface attachment, according to the present invention.

An embodiment of a box broom sweeper with adjustable bottom surface attachment 100 includes a box broom 120 having a broom B and a housing 110, as shown in FIGS. 1-3. As shown more clearly in FIG. 3, the box broom 120 includes an adjustable bottom surface attachment 300. The box broom 120 can be configured in any suitable manner known in the art. For example, the box broom 120 can include a housing 110 having a top surface 130, a bottom surface 140, a front end 160, a rear end 170, and two opposing side walls 190, connecting the top surface 130 and the bottom surface 140 of the housing 110. The rear end 170 can be in communication with a vehicle 180, such as a skid steer. As shown in FIG. 3, the bottom surface 140 can have a plurality of skid plates 150 and a guard 155. The housing 110 can be adapted to receive debris, such as sand, dirt, sticks, grass, small litter, loose gravel, small debris, as well as crushed lime, coke, and finished cement product swept up by the broom B.

As illustrated in FIG. 3, the adjustable bottom surface attachment 300 includes a plate 315 having a front edge portion 320 and two opposing flanges or sides 305 extending from the plate 315, e.g. normal to the plate 315. Each of the two opposing sides 305 can include an inner face 310*a* and an outer face 310*b*. Each of the two opposing sides 305 are configured to extend at least partially along a respective side wall 190 of the housing 110. The sides 305 can be connected to the box broom 120, e.g., detachably connected, in any suitable manner, e.g., by welding. Alternatively, the adjustable bottom surface attachment 300 can be coupled to the box broom 120 by one or more suitable fasteners, such as bolts.

The adjustable bottom surface attachment 300 can be formed from any suitable material. The adjustable bottom surface attachment 300 can be made from steel, preferably T-1 steel. The adjustable bottom surface attachment 300 can be disposed over the bottom surface 140 of the housing 110 to protect the bottom surface 140, e.g., the guard 155, from becoming damaged as the box broom 120 is pushed forward F, as illustrated in FIG. 1, or pulled in reverse R, as illustrated in FIG. 2, to collect debris from a ground surface.

The adjustable bottom surface attachment 300 can be of any suitable size. For example, the width W of the adjustable bottom surface attachment 300 can be from about 60 inches to about 84 inches. The length L of the adjustable bottom surface attachment 300 can be from about 4 feet to about 6 feet. The thickness T of the adjustable bottom surface attachment 300 can be from about ⅞ inches to about one inch. The adjustable bottom surface attachment 300 can be configured to have dimensions appropriate to protect the bottom surface 140, e.g., the guard 155, from contact with a ground surface. The dimensions of the adjustable bottom surface attachment 300 can vary. The adjustable bottom surface attachment 300 can be configured to fit onto a variety of box brooms, such as box brooms having a width of 60 inches or a width of 84 inches.

As illustrated in FIG. 3, by way of operation, the inner face 310*a* of each side wall 305 of the adjustable bottom surface attachment 300 can contact corresponding sides 190 of the housing 110. The sidewalls 305 are coupled, e.g., removably coupled, to a corresponding side 190 of the housing 110 of the box broom 120. Each side 305 of the plate 315 of the adjustable bottom surface attachment 300 can be welded onto the corresponding side 190 of the housing 110 of the box broom 120. Once the adjustable bottom surface attachment 300 is coupled to the housing 110, the plate 315 covers the bottom surface 140, including the guard 155 and the skid plates 150. The front edge portion 320 of the bottom surface 140 can be aligned with the guard 155. The adjustable bottom surface attachment 300 can be disposed over the bottom surface 140 of the housing 110.

As the box broom 120 moves forward F (FIG. 1) or in reverse R (FIG. 2) on a surface to collect debris, the adjustable bottom surface attachment 300 can become damaged or thinner over time. A used or damaged adjustable bottom surface attachment 300 can be removed from the housing 110 and replaced with a new adjustable bottom surface attachment 300. For example, the welds coupling each side 305 of the adjustable bottom surface attachment 100 to the sides 190 of housing 110 can be removed, e.g., by heating, cutting, or grinding down on the welds so as to detach the adjustable bottom surface attachment 300 from the housing 110. If only the front portion 320 of the adjustable bottom surface attachment 300 is damaged, the damaged front portion 320 can be removed by removing the adjustable bottom surface attachment 300 from the box broom 120 and cutting the damaged portion off. A remainder of the adjustable bottom surface attachment 300 can include a front portion 320 with sufficient thickness to cover and protect the guard 155. The remainder of the bottom surface attachment 300 can then be repositioned on and coupled to the housing 110.

As an alternative to welding, it should be understood that any suitable attachment method known in the art can be used to detachably connect the adjustable bottom surface attachment 300 to the housing 110 of the box broom 120. For example, a mounting rail can be provided on opposing side walls 190 which can be coupled to opposing flanges of the adjustable bottom surface attachment 300 with one or more fasteners. The mounting rail can facilitate repositioning and/or removal of the adjustable bottom surface attachment 300.

It is to be understood that the present invention is not limited to the embodiments described above, but encompasses any and all embodiments within the scope of the following claims.

I claim:

1. A box broom sweeper with an adjustable bottom surface attachment comprising:

a box broom having a broom and a housing, the housing including a top surface, a bottom surface, a front end, a rear end, and two opposing side walls connecting the top surface and the bottom surface, the bottom surface including a guard; and an adjustable bottom surface attachment detachably connected to the housing bottom surface, the adjustable bottom surface attachment including a plate having two opposing flanges extending upward from the plate, the two opposing flanges adapted to extend at least partially along the respective side walls of the housing.

2. The box broom sweeper with an adjustable bottom surface attachment according to claim 1, wherein the adjustable bottom surface attachment is welded to the side walls of the housing.

3. The box broom sweeper with an adjustable bottom surface attachment according to claim 1, wherein a width of the adjustable bottom surface attachment is about 60 inches to about 84 inches.

4. The box broom sweeper with an adjustable bottom surface attachment according to claim 1, wherein a length of the plate is about 4 feet to about 6 feet.

5. The adjustable bottom surface attachment according to claim 1, wherein a thickness of the plate is about ⅞ inches to about 1 inch.

6. The box broom sweeper with an adjustable bottom surface attachment according to claim 1, wherein a front edge of the adjustable bottom surface attachment is aligned with the guard of the housing.

* * * * *